US005597358A

United States Patent [19]

Marcu

[11] Patent Number: 5,597,358

[45] Date of Patent: Jan. 28, 1997

[54] FREE FALL SYSTEM

[76] Inventor: Mihail I. Marcu, 43 Renata Court, Dundas, Ontario, Canada, L9H 6X2

[21] Appl. No.: 253,130

[22] Filed: Jun. 2, 1994

[51] Int. Cl.[6] ..... A63J 5/12

[52] U.S. Cl. ..... 472/50; 472/131; 472/135; 472/137; 434/29; 434/35; 434/55

[58] Field of Search ..... 472/50, 131, 135–137; 434/29, 30, 34, 35, 45, 51, 58, 59, 55

[56] References Cited

U.S. PATENT DOCUMENTS 2,221,215 11/1940 Everly ..... 472/50
2,229,201 1/1941 Williford et al. ..... 472/50
4,487,410 12/1984 Sassak ..... 472/131
4,545,574 10/1985 Sassak ..... 472/131
4,997,060 3/1991 Sassak ..... 472/131 X

*Primary Examiner*—Carl D. Friedman
*Assistant Examiner*—Beth A. Aubrey

[57] ABSTRACT

A vertical free fall system is proposed where a capsule with human beings is raised pneumatically in a tube, then is released to fall down in a free fall mode inside of the tube. The capsule has some means of controlling the air flow passing across the capsule so that the rate of deceleration is controlled. In this way the capsule is able to free fall then to be decelerated to the bottom of the tube. Also the tube has means to control the flowing air by this being possible to control the deceleration of the said capsule.

1 Claim, 1 Drawing Sheet

FREE FALL SYSTEM

BACKGROUND OF THE INVENTION

The invention is related to free falling systems in vertical tubes with pneumatic propulsion destined specially for amusement parks.

PRIOR ART

There are known systems for free falling but using cables to rise the capsule and then after free falling the braking is made with friction.

These known systems have the following disadvantages:

involve cable systems (drums, cable, hoist, electric motor, fluid coupling, speed reducers).

involve long braking systems to brake the capsule after free falling; these braking systems involve friction, therefore wear parts.

occupy a lot of space-specially the braking portion.

involve sophisticated guiding systems because of the high speeds involved.

have limited raising speed because of the cable system.

SUMMARY OF THE INVENTION

The invention proposed herein eliminates the above disadvantages by the fact that involves:

a) A tubular structure with interior and exterior walls;

b) wherein the tubular structure is vertical or inclined;

c) a container/capsule, this container/capsule having an upper part and a bottom part, the container/capsule being within the tubular structure;

d) wherein at the upper part and at the bottom part there are gaskets, said gaskets being flexible, able to expand and these gaskets having on them rollers, these rollers rolling pressed on the interior walls of the tubular structure so that the gaskets are touching or almost touching the interior wall of the tubular structure, the gap between the gasket and the tubular structure being between 0.004–1 inch;

e) wherein the container/capsule has a communication tube between the upper part and the bottom part, this communication tube being a tube or a pipe so that the whole assembly made of the container/capsule, gaskets and the communication tube is like a spool if the tubular structure is cylindric;

f) a valve, able to close or open the communication tube;

g) a positive or desmodromic mechanism connected with the valve;

h) a counterweight connected via the positive mechanism with the valve so that any positive movement of the counterweight is translated into a positive movement of the valve being it closing or opening of the valve, the counterweight having seals, these seals being part of the counterweight;

i) a tube closed at both ends and having at both ends droseling taps (that is able to adjust the flow) connecting the inside and outside of the tube;

j) the counterweight being inside of the tube;

k) the gap between the counterweight and the tube being small or the seal touching the inner wall of the tube;

l) wherein the counterweight is able to move in vertical direction inside of the tube;

m) wherein the said tube is closed at both ends with tight lids and the positive mechanism is passing trough the one of the lid via a packing gland;

n) a spring herein after called the valve return spring pressing the valve in closed position;

o) wherein the valve return spring tends to keep the valve closed all the time, but if the counterweight is moving then via the positive mechanism, the valve will open automatically, the movement of the counterweight being downwards;

p) shock absorbing springs;

r) wherein the shock absorbing springs are placed at the bottom part of the tubular structure;

s) a breathing valve placed on the wall of the tubular structure at a certain height from the ground, this valve putting into communication the inner space of the said tubular structure with the atmosphere;

t) a drosseling valve (that is able to control the flow) placed at the bottom of the tubular structure, this drosseling (strangulation) valve also putting into communication the inner space of the said tubular structure with the atmosphere;

u) a fan or blower placed at the bottom part of the tubular structure, this fan bringing air from atmosphere and forcing it inside of the tubular structure, this fan having at the exit a flap valve which closes if there is pressure inside of the tubular structure and opens if the pressure of the blower is bigger than the pressure inside the tubular structure;

v) a servoactuated valve able to close or open the communication tube;

w) an accelerometer to sense the vertical acceleration;

x) a power supply;

y) a microprocessor controlled actuator to actuate the servoactuated valve:

z) a microprocessor controller connected with the accelerometer and with the microprocessor controlled actuator and the power supply;

a1) a dedicated software in form of dedicated control card to relate the movement of the actuator with the acceleration sensed by the accelerometer;

a2) wherein the servoactuated valve, the microprocessor controlled actuator, the microprocessor controller, the accelerometer, the power supply and the dedicated card are all together contained on the container/capsule, the servo actuated valve being able to close the communication tube aboard the container/capsule;

a3) a container/capsule access door;

a4) a tubular structure access door;

a5) stools or harnesses for passengers inside of the container/capsule;

a6) a stopper with shock absorbing means rigidly connected with the tubular structure, placed inside of the tubular structure and stopping the rising movement of the container/capsule;

The way of operation of the proposed free fall system is as follows:

The container/capsule is raised up by the fan or blower; when the container/capsule is raised inside of the tubular stricture, the breathing valve stays closed; also the valve closing the communication tube is closed; when the container/capsule reaches a certain height, the fan/blower stops, the breathing valve is open and the container/capsule falls down inside the tubular structure reaching speeds up to 100 mph; when the container/capsule falls, the counterweight or the accelerometer will react creating an opening or closing force for the valve which closes the communication tube; the system has to be adjusted to avoid accelerations bigger than 4 g to protect the people inside; the droseling(adjusting) valve at the bottom of the tube could also control the braking of the falling container/capsule; at the end of the process the container/capsule will touch with moderate speed (cca 1 ft/sec) the shock absorbing springs at the bottom of he tubular structure; the container/capsule is limited in the upward motion by the stopper with shock absorbing means; the people are entering and getting out in and out of the container/capsule and the tubular structure via the access doors using the known sealing and actuating means; the people are seated or harnessed inside of the container/capsule.

The counterweight being able to move only vertically will be sensible to the g forces (gravitational, inertial—but vertical). So if we have say 4 g vertical deceleration then the weight of the counter weight will be increased 4 times and consequently it will act via the positive mechanism the closing valve. In this way we have a direct proportional amplified actuating signal connected with the vertical acceleration. The microprocessor controlled actuator will do the same thing.

BRIEF DESCRIPTION OF THE DRAWING

Below is an illustration of the invention related to FIG. 1, 2, 3 representing.

DESCRIPTION OF THE PREFERRED EMBODIMENTS

Figure 1:
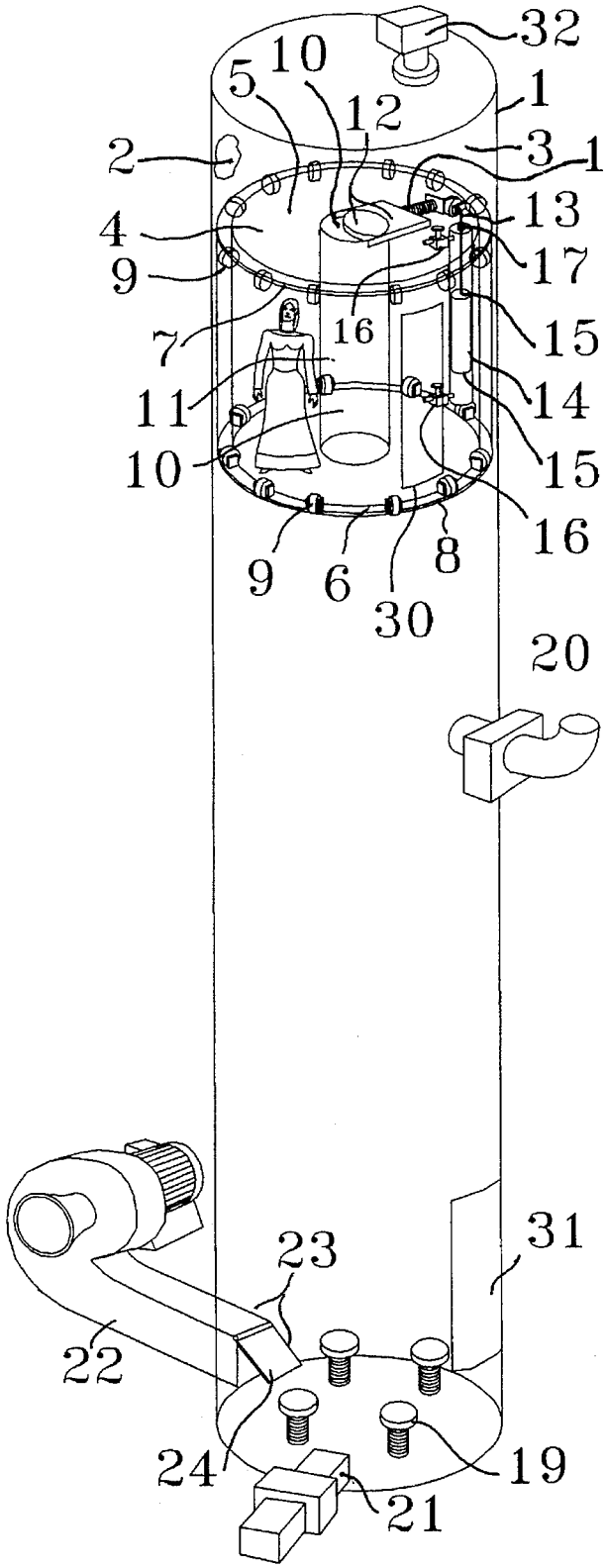
FIG. 1—a perspective view of the free fall system.
Figure 2:
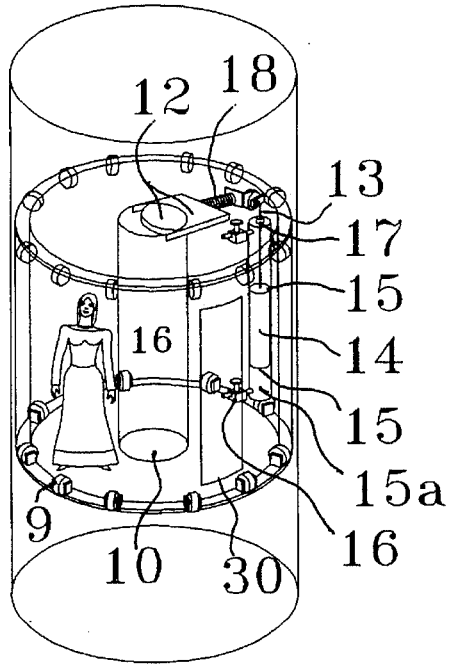
FIG. 2—a perspective view of the communication tube and counterweight mechanism.
Figure 3:
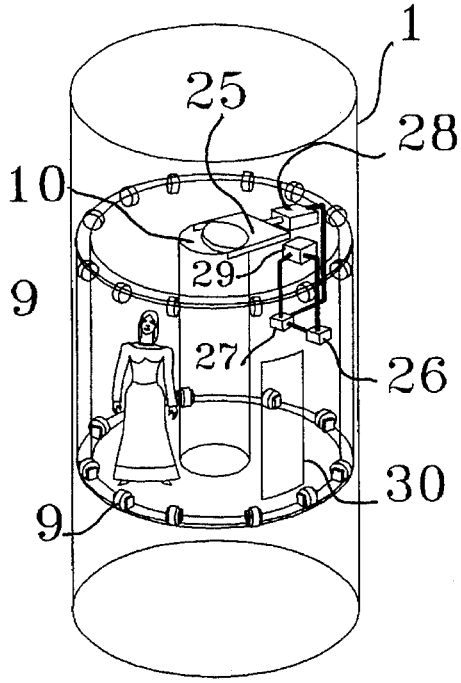
FIG. 3—a perspective view of the microprocessor controlled actuator mechanism.

As illustrated the system is made of:

a) A tubular structure 1 with interior 2 and exterior 3 walls;

b) wherein the tubular structure is vertical or inclined;

c) a container/capsule 4, this container/capsule having an upper 5 part and a bottom part 6, the container/capsule being within the tubular structure;

d) wherein at the upper part and at the bottom part there are gaskets 7, 8, said gaskets being flexible, able to expand and these gaskets having on them rollers 9, these rollers rolling pressed on the interior walls 2 of the tubular structure so that the gaskets are touching or almost touching the interior wall of the tubular structure, the gap between the gasket and the tubular structure being between 0.004–1 inch;

e) wherein the container/capsule has a communication tube 10 between the upper part and the bottom part, this communication tube being a tube or a pipe 11 so that the whole assembly made of the container/capsule, gaskets and the communication tube is like a spool if the tubular structure is cylindric;

f) a valve 12, able to close or open the communication tube;

g) a positive or desmodromic mechanism 13 connected with the valve;

h) a counterweight 14 connected via the positive mechanism with the valve so that any positive movement of the counterweight is translated into a positive movement of the valve being it closing or opening of the valve, the counterweight having seals 15, these seals being part of the counterweight;

i) a tube 15*a* closed at both ends and having at both ends droseling taps 16 (that is able to adjust the flow) connecting the inside and outside of the tube;

j) the counterweight being inside of the tube;

k) the gap between the counterweight and the tube being small or the seal touching the inner wall of the tube;

l) wherein the counterweight is able to move in vertical direction inside of the tube;

m) wherein the said tube is closed at both ends with tight lids and the positive mechanism is passing trough the one of the lid via a packing gland 17;

n) a spring 18 herein after called the valve return spring pressing the valve in closed position;

o) wherein the valve return spring tends to keep the valve closed all the time, but if the counterweight is moving then via the positive mechanism, the valve will open automatically, the movement of the counterweight being downwards;

p) shock absorbing springs 19;

r) wherein the shock absorbing springs are placed at the bottom part of the tubular structure;

s) a breathing valve 20 placed on the wall of the tubular structure at a certain height from the ground, this valve putting into communication the inner space of the said tubular structure with the atmosphere;

t) a drosseling valve 21 (that is able to control the flow) placed at the bottom of the tubular structure, this drosseling (strangulation) valve also putting into communication the inner space of the said tubular structure with the atmosphere;

u) a fan or blower 22 placed at the bottom part of the tubular structure, this fan bringing air from atmosphere and forcing it inside of the tubular structure, this fan having at the exit 23 a flap valve 24 which closes if there is pressure inside of the tubular structure and opens if the pressure of the blower is bigger than the pressure inside the tubular structure;

v) a servoactuated valve 25 able to close or open the communication tube;

w) an accelerometer 26 to sense the vertical acceleration;

x) a power supply 27;

y) a microprocessor controlled actuator 28 to actuate the servoactuated valve;

z) a microprocessor controller 29 connected with the accelerometer and with the microprocessor controlled actuator and the power supply;

a1) a dedicated software in form of dedicated control card to relate the movement of the actuator with the acceleration sensed by the accelerometer;

a2) wherein the servoactuated valve, the microprocessor controlled actuator, the microprocessor controller, the accelerometer, the power supply and the dedicated card are all together contained on the container/capsule, the servo actuated valve being able to close the communication tube aboard the container/capsule;

a3) a container/capsule access door 30;

a4) a tubular structure access door 31;

a5) stools or harnesses for passengers inside of the container/capsule;

a6) a stopper with shock absorbing means 32 rigidly connected with the tubular structure, placed inside of the tubular structure and stopping the rising movement of the container/capsule;

The way of operation of the free fall system as illustrated is as follows:

The container/capsule 4 is raised up by the fan or blower 22; when the container/capsule is raised inside of the tubular stricture 1, the breathing valve 20 stays closed; also the valve 12 closing the communication tube 10 is closed; when the container/capsule reaches a certain height, the fan/blower stops, the breathing valve 20 is open and the container/capsule 4 falls down inside the tubular structure reaching speeds up to 100 mph; when the container/capsule falls, the counterweight 14 or the accelerometer 26 will react creating an opening or closing force for the valve which closes the communication tube 10; the system has to be adjusted to avoid accelerations bigger than 4 g to protect the people inside; the droseling(adjusting) valve 21 at the bottom of the tube could also control the braking of the falling container/capsule; at the end of the process the container/capsule will touch with moderate speed (cca 1 ft/sec) the shock absorbing springs 19 at the bottom of he tubular structure; the container/capsule is limited in the upward motion by the stopper 32 with shock absorbing means; the people are entering and getting out in and out of the container/capsule and the tubular structure via the access doors 30,31 using the known sealing and actuating means; the people are seated or harnessed inside of the container/capsule 4.

The counterweight 14 being able to move only vertically will be sensible to the g forces (gravitational, inertial—but vertical). So if we have say 4 g vertical deceleration then the weight of the counter weight will be increased 4 times and consequently it will act via the positive mechanism 13 the closing valve 12. In this way we have a direct proportional amplified actuating signal connected with the vertical acceleration. The microprocessor controlled actuator 28 will do the same thing.

What is claimed is:

1. A free fall system comprising;

a tubular structure with interior and exterior walls and a bottom, said tubular structure disposed at an angle to the horizontal;

a capsule having an upper and lower part, the capsule disposed within the tubular structure;

gaskets disposed at the upper and lower parts of the capsule, said gaskets being flexible and expandable;

rollers disposed on the gaskets, the rollers pressed on the interior wall of the tubular structure such that the gaskets are adjacent the interior wall of the tubular structure;

a gap between the gasket and tubular structure being between 0.0004–1.000 inches;

a communication tube disposed between the upper and lower parts of the capsule;

a valve able to close or open the communication tube;

a mechanism connected to the valve, the mechanism being positive or desmodromic;

a tube tightly closed at both ends and having adjustable flow droseling taps at both ends connecting the inside and outside of the tube;

a counterweight connected via the mechanism to the valve, any positive movement of the counterweight is translated into a positive movement of the valve such that the valve opens or closes, said counterweight has seals, the counterweight disposed within the tube, a small gap between the counterweight and the tube, wherein the counterweight is movable within the tube;

a packing gland, the mechanism passing through an end of the tube via the packing gland;

a valve return spring, wherein the spring keeps the valve closed while the counterweight is not moving, when the counterweight moves downward, the valve automatically opens;

shock absorbing springs, wherein the springs are disposed at the bottom of the tubular structure;

a breathing valve placed on the wall of the tubular structure at a predetermined height from the ground, said breathing valve allowing the space within the tubular structure and the atmosphere to be in communication;

a drosseling valve, said valve placed at the bottom of the tubular structure and allowing the space within the tubular structure and the atmosphere to be in communication;

a fan placed at the bottom of the tubular structure, said fan having an exit flap valve which closes if there is pressure inside the tubular structure and closes if the pressure of the fan is higher than the pressure inside the tubular structure;

an accelerometer to sense vertical acceleration;

a power supply;

a microprocessor controlled actuator to actuate the valve;

a microprocessor controller connected with the accelerometer and with the microprocessor controlled actuator and the power supply;

dedicated software, the software in the form of a dedicated control card to relate movement of the actuator with the acceleration sensed by the accelerometer, wherein the valve, the microprocessor controlled actuator, the microprocessor controller, the accelerometer, the power supply and the dedicated card are all contained on the capsule;

a capsule access door;

a tubular structure access door;

harnesses for passengers inside the capsule; and a stopper with shock absorbing means rigidly connected with the tubular structure, and able to stop the rising movement of the capsule.

* * * * *